United States Patent [19]

Brieseck

[11] Patent Number: 4,844,386

[45] Date of Patent: Jul. 4, 1989

[54] AIRBORNE BODY WITH EXTENDABLE FINS

[75] Inventor: Bernd Brieseck, Henfenfeld, Fed. Rep. of Germany

[73] Assignee: Diehl GmbH & Co., Nuremberg, Fed. Rep. of Germany

[21] Appl. No.: 173,314

[22] Filed: Mar. 25, 1988

[30] Foreign Application Priority Data

Apr. 14, 1987 [DE] Fed. Rep. of Germany ..... 3712704

[51] Int. Cl.[4] ..... F42B 15/027

[52] U.S. Cl. ..... 244/3.28

[58] Field of Search ..... 244/3.27, 3.28, 3.29, 244/49

[56] References Cited

U.S. PATENT DOCUMENTS

| | | | |
|---|---|---|---|
| 1,890,354 | 12/1932 | Armour et al. | 244/49 |
| 3,098,445 | 7/1963 | Jackson | 244/3.28 |
| 3,304,030 | 2/1967 | Weimholt et al. | 244/3.28 |
| 3,563,495 | 2/1971 | Korn | 244/3.29 |
| 3,861,627 | 1/1975 | Schoffl | 244/3.27 |
| 4,323,208 | 4/1982 | Ball | 244/3.28 |
| 4,600,167 | 7/1986 | Kastenhuber et al. | 244/3.28 |
| 4,664,339 | 5/1987 | Crossfield | 244/3.28 |
| 4,702,436 | 10/1987 | Arnell | 244/3.28 |
| 4,709,877 | 12/1987 | Goulding | 244/3.28 |

FOREIGN PATENT DOCUMENTS

| | | | |
|---|---|---|---|
| 1703105 | 1/1972 | Fed. Rep. of Germany | 42/3.28 |

*Primary Examiner*—Deborah L. Kyle
*Assistant Examiner*—Michael J. Carone
*Attorney, Agent, or Firm*—Scully, Scott, Murphy & Presser

[57] ABSTRACT

An airborne body with extendable fins or wing surfaces which are simultaneously extendable by the action of a drive element through the intermediary of a cam plate arrangement. The cam plate arrangement is formed by a cam plate which possesses two identically-shaped cam tracks for two fins, which tracks are mutually offset along the circumference of the cam plate, and whereby each cam track contacts against an actuating edge of one of the fins, and wherein the axis of rotation of the cam plate, about which it is rotatable through the action of the drive element, conincides with the longitudinal axis of the airborne body.

7 Claims, 2 Drawing Sheets

AIRBORNE BODY WITH EXTENDABLE FINS

BACKGROUND OF THE INVENTION

1. Field of the Invention

The present invention relates to an airborne body with extendable fins or wing surfaces which are simultaneously extendable by means of a drive element through the intermediary of a cam plate arrangement.

2. Discussion of the Prior Art

An airborne body of type referred to hereinabove is described in the specification of German Petty Pat. No. 1 906 425. In this airborne body, each fin has a cam plate arranged thereon. The cam plates are subjected to action of the pins of a ring which is subjected to pressure from a helical coil spring. When the cam plates are not all identically oriented, or in the event that the pins press differently against the cam plates, this brings into question the desired simultaneous extension of the fins.

Moreover, the disclosure of German Pat. No. 34 39 256 also describes an airborne body with two extendable wing surfaces or fins. The fins are interdigitated with each other such that upon the extension of the one fin, the other fin will follow. The support for the one fin must assume the force for the extension of the other fin. The reason for this is that the drive element engages only with one fin. This can lead to the encountering of asymmetries during the extension.

SUMMARY OF THE INVENTION

Accordingly, it is an object of the present invention, in an airborne body of the above-mentioned type to constructionally simplify the cam plate arrangement and to be able to attain a simultaneous extension of the fins.

Inventively, the above-mentioned object is achieved in an airborne body of the type described herein in that the cam plate arrangement is formed by a cam plate which possesses two identically-shaped cam tracks for two fins, which tracks are mutually offset along the circumference of the cam plate, and whereby each cam track contacts against an actuating edge of one of the fins, and wherein the axis of rotation of the cam plate, about which it is rotatable through the action of the drive element, coincides with the longitudinal axis of the airborne body.

When the drive element moves the cam plate, then through the intermediary of the one cam track there is extended the one fin, and the other fin is simultaneously extended by the other cam track. Inasmuch as both cam tracks are formed on the cam plate, this obviates the need for separate adjustment of the cam tracks. Inasmuch as each fin has its own cam track provided therefor, the actuating force for the one fin need not be transmitted to the other fin. Thus, overall, there is obtained a simultaneous and uniform extension of the wings. The arrangement of the axis of rotation of the cam plate in the longitudinal axis of the airborne body leads to a symmetrical construction and to a symmetrical extent of movement.

In the preferred embodiment of the invention, the wing surfaces or fins are fastened in their extended position through the intermediary of a latching arrangement which acts on the cam plate. As a consequence thereof, there are eliminated latching elements which must be individually provided on each of the fins.

BRIEF DESCRIPTION OF THE DRAWINGS

Further advantageous embodiments of the invention may now be readily ascertained from the following detailed description of an exemplary embodiment thereof, taken in conjunction with the accompanying drawings; in which.

DETAILED DESCRIPTION

Figure 1:
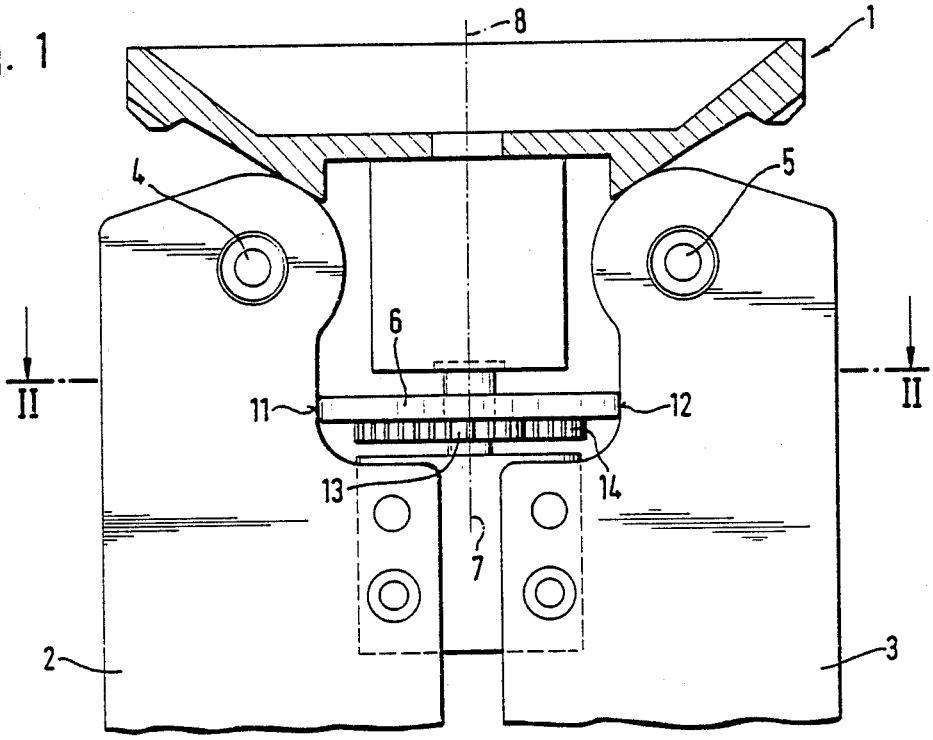
FIG. 1 illustrates a fragmentary view of an airborne body with two wing surfaces or fins.

Two fins 2, 3 on an airborne body 1 are supported for extension on bearing pins 4, 5. In FIG. 1 of the drawings, the fins 2, 3 are illustrated in their retracted position.

Figure 2:
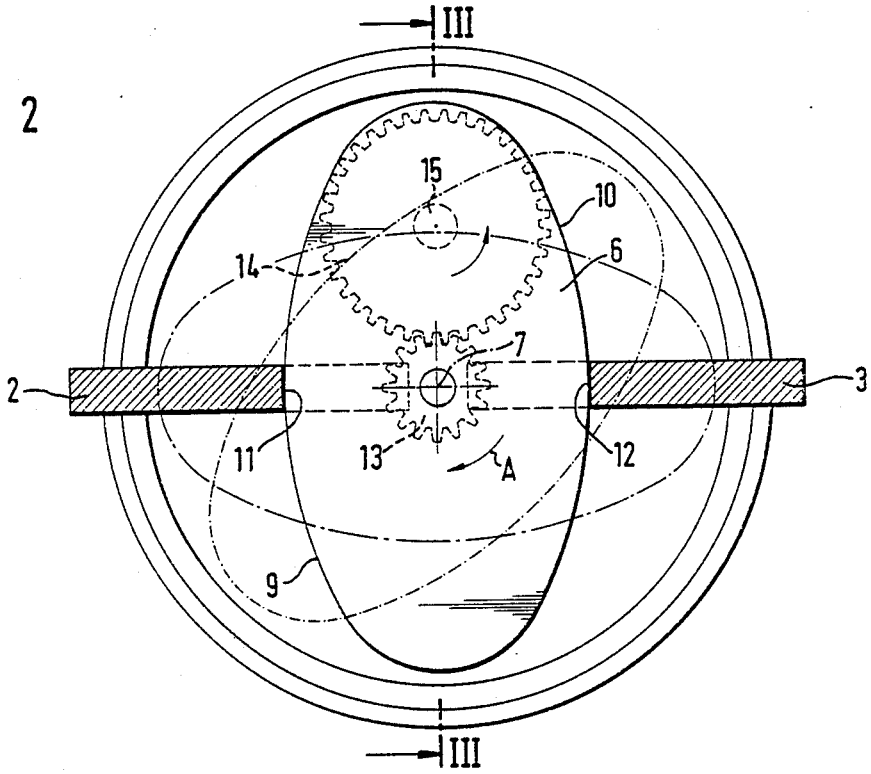
FIG. 2 illustrates a sectional view taken along line II—II in FIG. 1.
Figure 3:
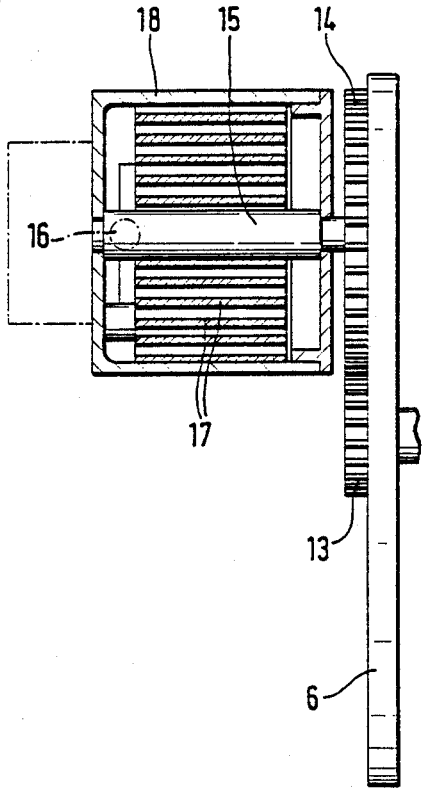
FIG. 3 illustrates a sectional view taken along line III—III in FIG. 2.

A cam plate 6 is supported on the airborne body 1 so as to be pivotable about an axis of rotation 7. The axis of rotation 7 coincides with the longitudinal axis 8 of the airborne body 1. The cam plate 6 possesses an elliptical configuration. Hereby, the cam plate forms a camming surface or cam track 9 and a camming surface or cam track 10. The two cam tracks 9, 10 extend over respectively 90° , are identical in configuration and are offset opposite each other along the circumference of the cam plate 6. The fins 2, 3 possess actuating edges 11 and respectively 12 which are associated with the cam tracks 9, 10. In the retracted position of the fins 2, 3, which is illustrated in FIGS. 1 and 2, the actuating edges 11, 12 contact against the small diameter of the elliptical cam plate 6.

Figure 4:
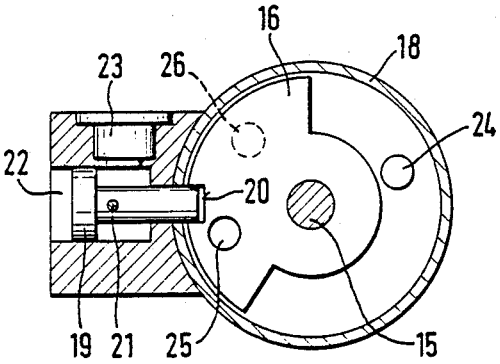
FIG. 4 illustrates a generally schematic fragmentary view of a drive or actuating element in its latched position.

A pinion 13 is fastened to the cam plate 6. This pinion engages with a gear 14. The gear 14 is seated on a shaft 15, on which there is fastened a securing plate 16. A spiral spring 17 is positioned so as to extend about the shaft 15, whereby one end of the spring is fastened to the shaft 15 and the other end to a housing 18 which is attached to the airborne body. In the position illustrated in FIGS. 1 and 2, the securing plate 17 is latched (refer to FIG. 4). Hereby, an unlatching piston 19 engages into a recess 20 of the securing disc 16, which is retained by means of a shear pin 21. The unlatching piston 19 is guided within a chamber 22, having a flame-jet capsule 23 connected thereto.

The mode of operation for the extension of the fins 2, 3 is generally as follows:

When the flame-jet capsule 23 is ignited, the shear pin 21 will fracture and the unlatching piston 19 removes itself from the recess 20. The spiral spring 17 now rotates the shaft 15 which is no longer arrested by the securing disc 16, whereby the gear 14 and thereby also the pinion 13 will rotate. As a result thereof, the cam plate 6 is rotated in the direction of arrow A, as shown in FIG. 2. The cam tracks 9, 10 of the cam plate hereby press against the actuating edges 11, 12, as a result of which the fins 2, 3 are extended.

Figure 5:
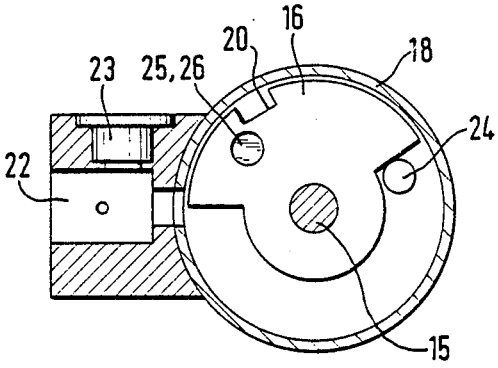
FIG. 5 illustrates the drive element in an unlatched position thereof.

When the cam plate 6 is rotated through an angle of 90°, the fins 2, 3 are fully extended. In this position, the securing disc 16 contacts against a stop 24, (as shown in FIG. 5) and a spring-loaded bolt 26 engages into a bore 25 in the securing disc 16. Thereby, the cam plate 6 and, as a result, also the fins 2, 3 are locked in their extended position.

The time which passes between the beginning of the movement of the cam plate 6 and the locking thereof can be adjusted through the dimensioning of the spiral spring 17 and through the selection of the gear ratio between the gear 14 and the pinion 13.

The cam plate 6 or the gear 14, pursuant to another exemplary embodiment of the invention, can be also actuated by means of another drive element than that of the described spiral spring. For example, a pyrotechnic power element can be employed for this purpose.

What is claimed is:

1. An airborne body with a plurality of extendable fins which are simultaneously extendable by a drive element through a cam plate arrangement, said cam plate arrangement including a cam plate having two identically-configured cam tracks offset opposite each other and extending about the cam plate for two of said fins, each said cam track respectively contacting an actuating edge on one of said fins, and a pinion being mounted on the cam plate, said pinion being in engagement with a gear which is actuatable by the drive element.

2. An airborne body as claimed in claim 1, wherein said claim plate has an axis of rotation about which said plate is driven by said drive element, said axis of rotation coinciding with the longitudinal axis of the airborne body.

3. An airborne body as claimed in claim 1, wherein a latching arrangement acting on the cam plate latches said fins in their extended position.

4. An airborne body as claimed in claim 1, wherein said drive element comprises a spiral spring.

5. An airborne body as claimed in claim 1, wherein said gear is seated on a shaft; a securing disc being arranged on said shaft; securing disc having a latching means for the retracted position of the fins and locking means for maintaining the extended position of the fins.

6. An airborne body as claimed in claim 1, wherein said cam plate is elliptically-shaped.

7. An airborne body as claimed in claim 6, wherein said cam plate is rotated through an angle of about 90° from the retracted position to the extended position of the fins.

* * * * *